US005816837A

United States Patent [19]

Henrici et al.

[11] Patent Number: 5,816,837

[45] Date of Patent: Oct. 6, 1998

[54] FLUORESCENT-LAMP SOCKET ASSEMBLY

[75] Inventors: Dieter Henrici, Arnsberg; Karl-Wilhelm Vogt, Ense; Hartmut Greschner, Arnsberg, all of Germany

[73] Assignee: Brokelmann, Jaeger & Busse, GmbH & Co., Arnsberg, Germany

[21] Appl. No.: 698,992

[22] Filed: Aug. 16, 1996

[30] Foreign Application Priority Data

Aug. 16, 1995 [DE] Germany ..... 195 30 115.3

[51] Int. Cl.[6] ..... H01R 33/02

[52] U.S. Cl. ..... 439/231; 439/241; 362/221

[58] Field of Search ..... 439/226, 227, 439/228, 229, 230, 239, 240, 241, 231; 362/221, 260

[56] References Cited

U.S. PATENT DOCUMENTS

| | | | |
|---|---|---|---|
| 3,133,704 | 5/1964 | Kampmann | 362/221 |
| 3,401,242 | 9/1968 | McLaughlin | 439/240 |
| 3,975,073 | 8/1976 | McLaughlin | 439/241 |
| 4,198,108 | 4/1980 | Bassetto | 362/260 |
| 4,198,109 | 4/1980 | Ustin | 439/239 |

FOREIGN PATENT DOCUMENTS

| | | | |
|---|---|---|---|
| 0070491 | 1/1950 | Denmark | 439/239 |
| 23 30 097 | 1/1975 | Germany . | |

*Primary Examiner*—Neil Abrams
*Assistant Examiner*—Katrina Davis
*Attorney, Agent, or Firm*—Herbert Dubno; Andrew Wilford

[57] ABSTRACT

A fluorescent-lamp socket assembly has a socket, a standard base, and a starter base. The socket has a nonconductive housing having an open end and a pair of conductors in the housing engageable with contact pins of a lamp fitted to the housing and exposed in the open housing end. The standard base is shaped to fit complementarily into and close the open housing end and is formed with throughgoing holes through which wires can be engaged with the conductors. The starter base has a one-piece nonconductive housing having a plug end shaped to fit complementarily into and close the open housing end and an opposite end adapted to hold a starter and a conductor inside the starter-base housing for connecting a starter in the opposite end with one of the conductors in the socket.

4 Claims, 5 Drawing Sheets

FLUORESCENT-LAMP SOCKET ASSEMBLY

FIELD OF THE INVENTION

The present invention relates to a lamp socket assembly. More particularly this invention concerns a socket assembly for a fluorescent lamp that may be equipped with a starter.

BACKGROUND OF THE INVENTION

A standard fluorescent lamp has two conductor pins extending from each end. To initiate fluorescence a coil in the bulb that is connected between two pins is heated briefly. Thus the lamp is fitted as described in German patent document 2,330,097 of Ullrich at one end into a socket which allows individual connections to be made to the two pins fitted to it and at the other end to a socket set up so that one of the pins can be connected to directly while the other pin is connected directly to one side of a starter to whose other side the wired connection is made.

Thus the manufacturer must create several different socket subassemblies. One subassembly has a nonconductive housing holding a pair of conductors that are inserted through an open end that in turn is closed by a cover plate or plug. One end of each conductor is positioned to be engaged by one of the pins of the respective lamp end and an opposite end adapted to be connected to near the base of the housing. Another subassembly has a nonconductive housing with a pair of pin-engaging conductors and also formed as a holder for a starter at some spacing from where the bulb actually is received. In this starter subassembly an internal conductor connects one of the pins of the lamp to the one side of the starter, and a cover plate covers the back side of the housing to contain the various wires and conductors. Thus at least four different housing pieces need to be molded.

Fluorescent lamps come in 26 mm and 38 mm diameters adapted to be offset by 22.5 mm and 30 mm on center, so that long and short housings have to be made, further increasing the different parts that need to be made to accommodate these two sizes. Manufacturing and stocking these lamp parts, which should be a cheap mass-produced item, is therefore unnecessarily complicated.

OBJECTS OF THE INVENTION

It is therefore an object of the present invention to provide an improved fluorescent-lamp socket assembly.

Another object is the provision of such an improved fluorescent-lamp socket assembly which overcomes the above-given disadvantages, that is which can be made up of fewer parts for reduced manufacturing costs.

SUMMARY OF THE INVENTION

A fluorescent-lamp socket assembly has according to the invention a socket, a standard base, and a starter base. The socket has a nonconductive housing having an open end and a pair of conductors in the housing engageable with contact pins of a lamp fitted to the housing and exposed in the open housing end. The standard base is shaped to fit complementarily into and close the open housing end and is formed with throughgoing holes through which wires can be engaged with the conductors. The starter base has a one-piece nonconductive housing having a plug end shaped to fit complementarily into and close the open housing end and an opposite end adapted to hold a starter and conductors inside the starter-base housing for connecting a starter in the opposite end with one of the conductors in the socket.

Thus with this system the socket itself is made in two different sizes but its open end is constructed identically regardless of the socket size. The standard base can fit in either the long or short socket, and so can the starter base. The overall number of basic housing parts that need to be molded, with two sizes of lamp, is four—standard base, starter base, long socket, short socket—that can be produced by four two-piece molds. These four parts can be combined to produce long or short standard or starter-equipped bases. The resultant saving in manufacturing costs is considerable.

In accordance with this invention the starter-base housing is formed unitarily with a pair of electrically isolated pockets and is provided in one of the pockets with an electrical contact. Its conductor extends into the other pocket and normally is formed as a wire having one end in the starter-base housing at the starter-holding end thereof and an opposite end extending from the plug end into the socket when the plug end is fitted to the socket.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
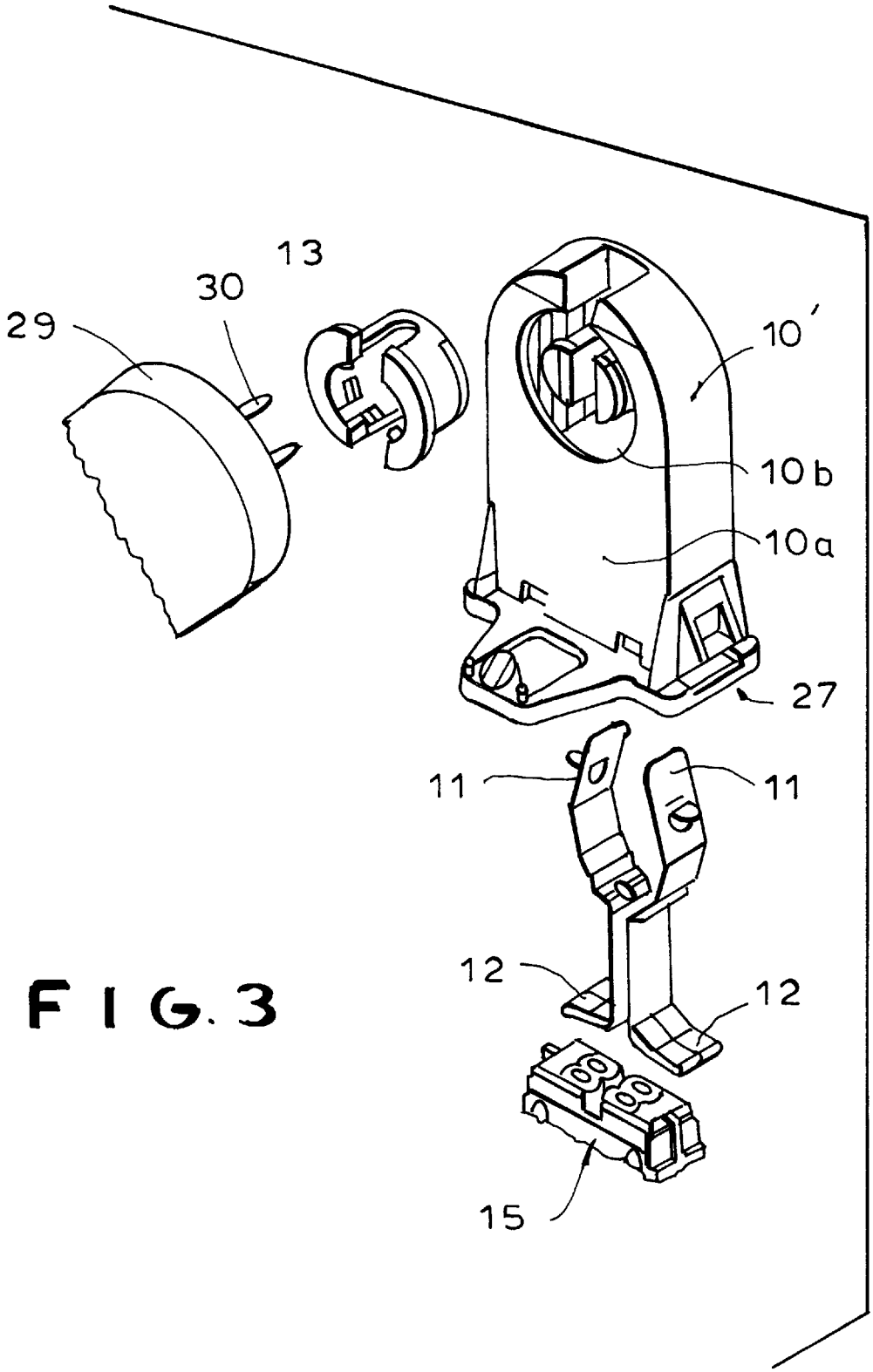
FIG. 3 is an exploded view of a 30-mm or long socket assembly using the standard base.

As seen in FIG. 3 a 30-mm long socket has a housing 10' having a face **10*a* formed with a cutout 10*b* in which are exposed pins 14 carrying a pivotal pin-receiving cup 13 for a fluorescent lamp 29 having at each end two connector pins 30. Inside the housing 10' which is made of nonconductive plastic are two copper-strip conductors 11 having lower ends positioned in an open end 27 of the housing 10' and constructed to make tight spring contact with connector wires. Upper ends of the conductors 11 flank the cutout 10*b* so that the pins 28 contact them when the lamp 29** is installed in the standard manner by slipping it in transversely and rotating it 90°.

Figures 1, 2:
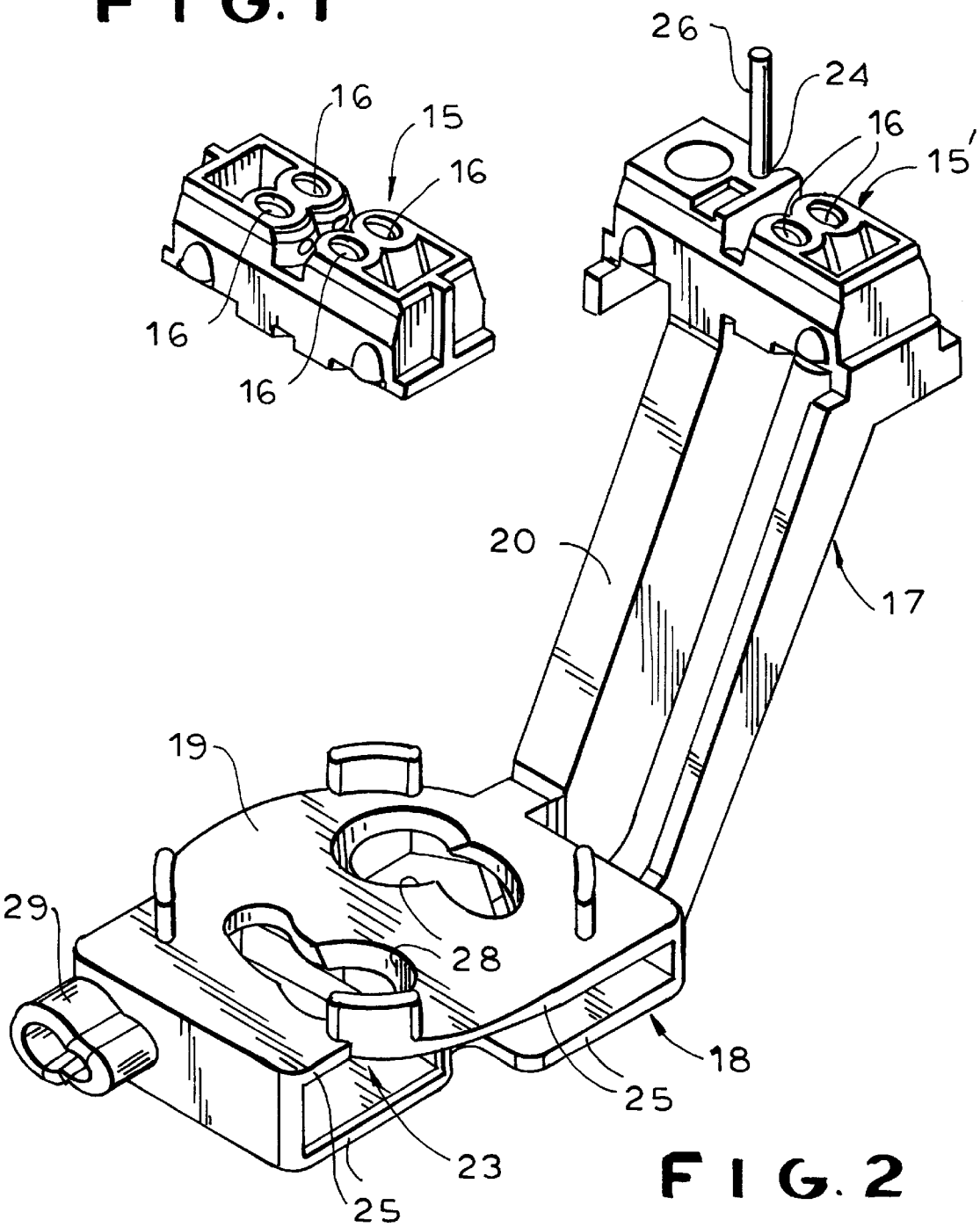
FIG. 1 is a perspective view of a standard base according to the invention.
FIG. 2 is a perspective view of a starter base according to the invention.

This open end 27 can be plugged by a standard base 15 as shown in FIG. 1 also. This base 15 is made of nonconductive plastic and is shaped to be a tight complementary fit in the cavity of the open end 27 so that it can be force-fitted therein and expected to hold in place, simultaneously containing the conductors 12 so that they are solidly retained. The standard base 15 is formed with two pairs of holes 16 that align with the contact feet 12 of the conductors 11 so that stripped wire ends can be poked through the holes 16 to form solid electrical contact with the conductors 11.

Figure 5:
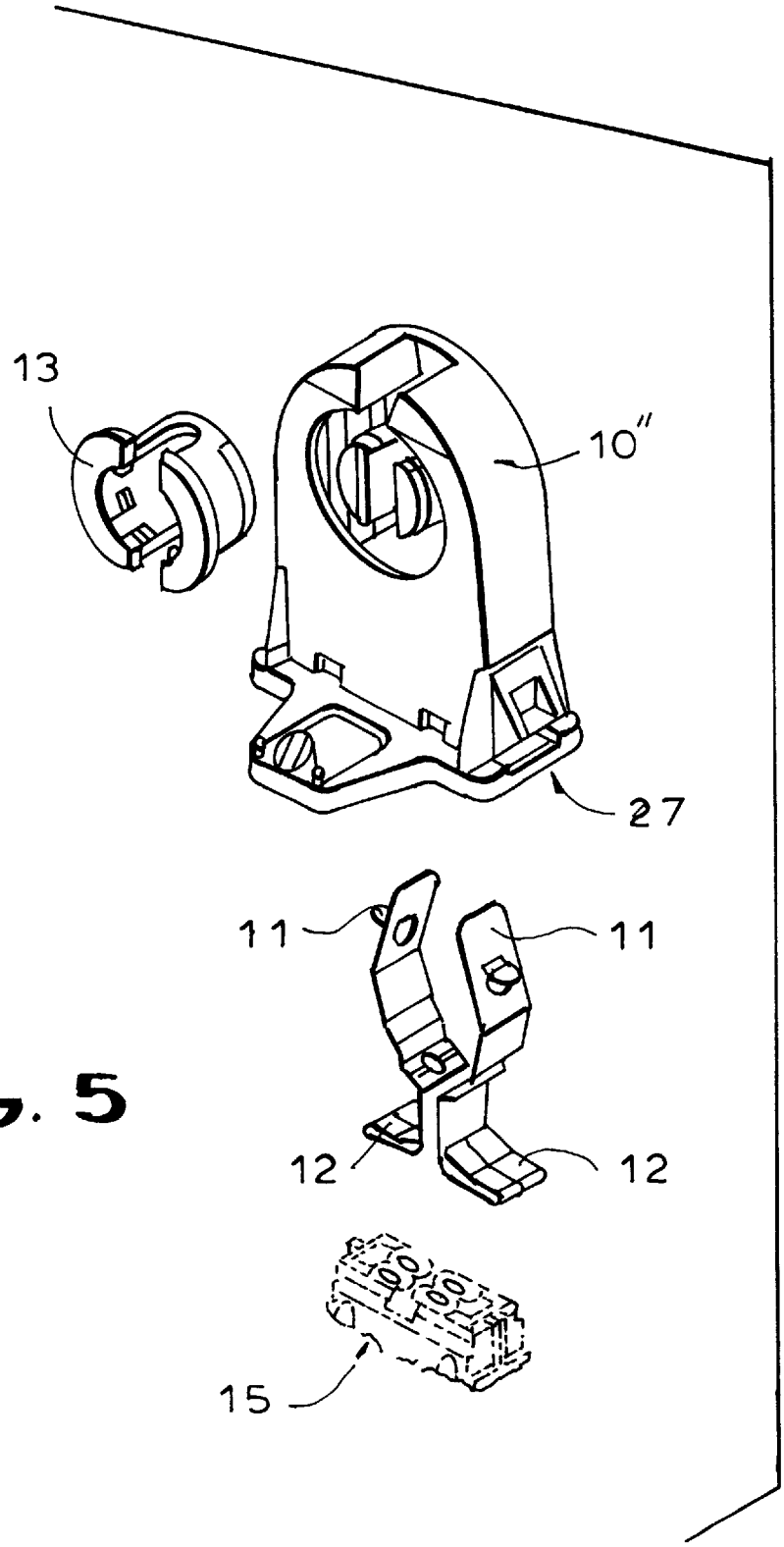
FIG. 5 is an exploded view of a 22.5-mm or short socket assembly using the standard base, parts identical to those of FIG. 3 being shown in dot-dash lines.
Figure 6:
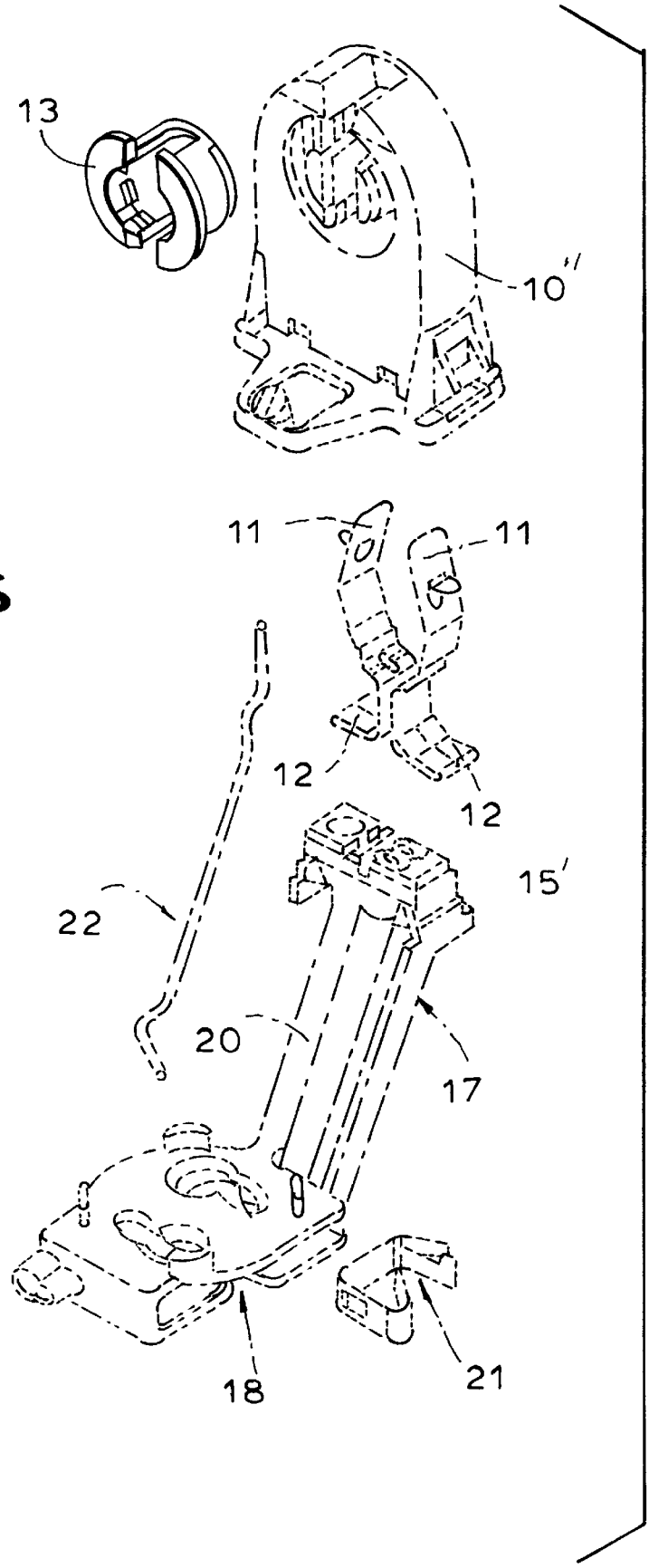
FIG. 6 is an exploded view of a short socket assembly using the starter base, parts identical to those of FIGS. 4 or 5 being shown in dot-dash lines.

The arrangement of FIG. 5 is identical to that of FIG. 3 but has a 22.5-mm short housing 10".

Figure 4:
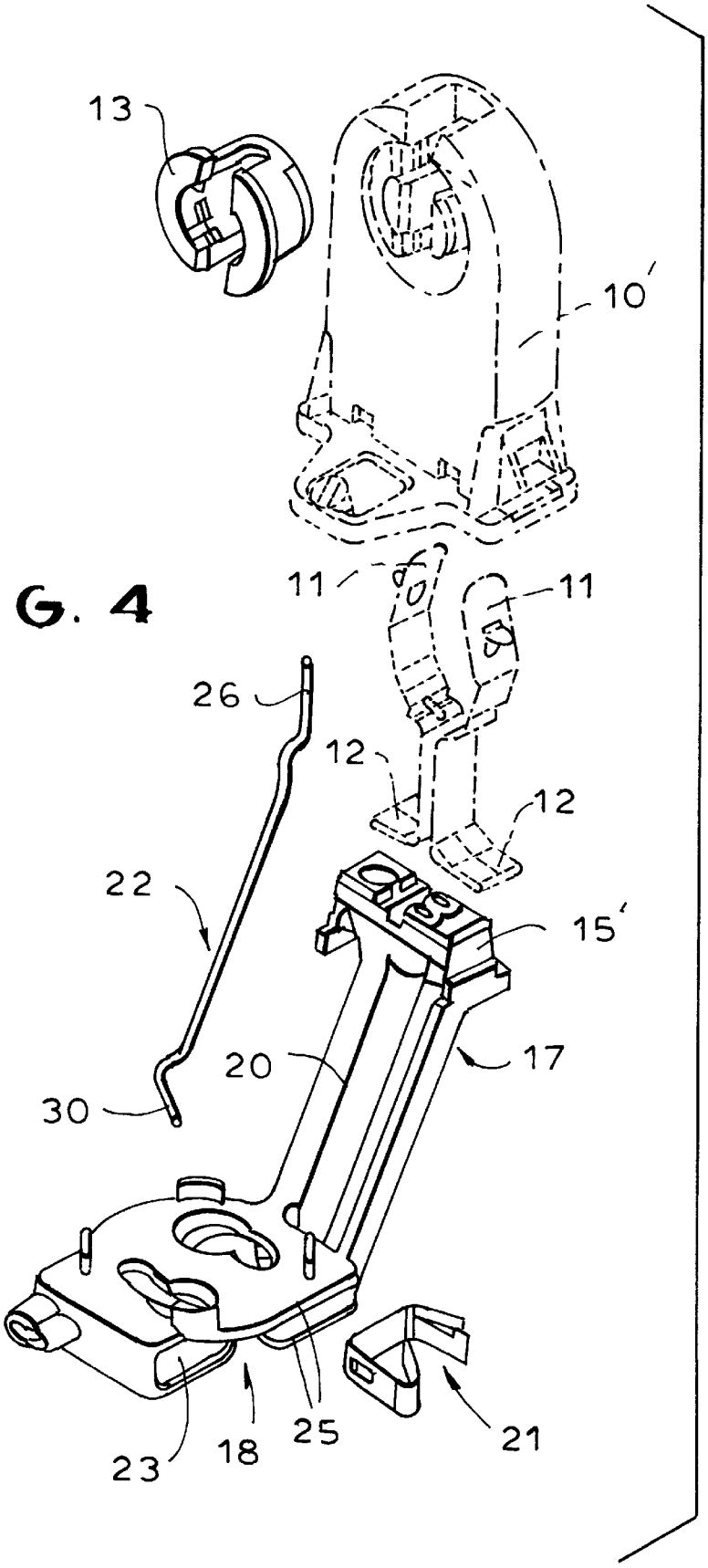
FIG. 4 is an exploded view of a long socket assembly using the starter base, parts identical to those of FIG. 3 being shown in dot-dash lines.

FIGS. 2 and 4 show a starter base having a housing 17 with an upper plug end 15' formed generally like the standard base so that it fits tightly complementarily in the open housing end 27, but with only two of the holes 16 aligned with one of the conductors 11. This housing 17 is unitarily also formed with a starter holder end 18 and a web 20 interconnecting the plug end 15' and holder 18. The holder end 18 is formed of a pair of walls 25 defining laterally open pockets 23 and has an upper surface 19 formed with a pair of terminal-receiving holes 28 opening into the respective pockets 23. One of the pockets 23 holds a conductor clip 21 to which a wire can be connected through a lateral hole 29.

A wire 22 (FIG. 4) has a lower end 30 engaged in the other pocket 23 and an opposite end 26 projecting from the plug end 15' of the housing 17. The web 20 is partially channel- or U-shaped to enclose the wire 22 between its ends 26 and 30 and the housing 17 is formed at the plug end 15' with a notch 24 that retains this wire 22 solidly in place.

Thus the manufacturer can produce standard-base and starter-base sockets using three basic subassemblies, one of which can be provided in two different sizes. This greatly reduces the unit cost for this mass-production item.

We claim:

1. A fluorescent-lamp socket assembly comprising:

a socket having a nonconductive housing having an open end, and a pair of conductors in the housing engageable with contact pins of a lamp fitted to the housing and exposed in the open housing end;

a standard base shaped to fit complementarily into and close the open housing end and formed with through-going holes through which wires can be engaged with the conductors; and a starter base having a one-piece nonconductive housing having a plug end shaped to fit complementarily into and close the open housing end and an opposite end adapted to hold a starter, and a one-piece conductor inside the starter-base housing connecting the starter in the opposite end with one of the conductors in the socket, the plug end being formed with a throughgoing hole through which a wire can be engaged with the other of the conductors.

2. The fluorescent-lamp socket assembly defined in claim 1 wherein the starter-base housing is formed unitarily with a pair of electrically isolated pockets and is provided in one of the pockets with an electrical contact, the conductive means extending into the other pocket.

3. The fluorescent-lamp socket assembly defined in claim 1 wherein the conductive means is a wire having one end in the starter-base housing at the starter-holding end thereof and an opposite end extending from the plug end into the socket when the plug end is fitted to the socket.

4. A fluorescent-lamp socket assembly comprising:

a socket having a nonconductive housing having a side face shaped to receive pins of a fluorescent lamp and an open lower end, and a pair of conductors in the housing engageable with contact pins of a lamp fitted to the face housing and exposed in the open housing end;

a standard base shaped to fit complementarily into and close the open housing end and formed with through-going holes through which wires can be engaged with the conductors; and a starter base having a one-piece nonconductive housing having a plug end shaped to fit complementarily into and close the open housing end, an opposite end adapted to hold a starter, and a rigid web unitarily connecting the plug end and the starter-holding end, a terminal in the starter-holding end, and a wire having one end in the starter-holding end and an opposite end projecting from the plug end and extending in the web between its ends.

* * * * *